US011185749B2

(12) United States Patent
Wiese

(10) Patent No.: US 11,185,749 B2
(45) Date of Patent: Nov. 30, 2021

(54) BAT HAVING AT LEAST ON DISC ALONG THE LENGTH OF THE BAT BARREL

(71) Applicant: Rawlings Sporting Goods Company, Inc., St. Louis, MO (US)

(72) Inventor: Peter Wiese, Caledonia, MN (US)

(73) Assignee: Rawlings Sporting Goods Company, Inc., St. Louis, MO (US)

( * ) Notice: Subject to any disclaimer, the term of this patent is extended or adjusted under 35 U.S.C. 154(b) by 0 days.

(21) Appl. No.: 16/569,933

(22) Filed: Sep. 13, 2019

(65) Prior Publication Data

US 2020/0086189 A1 Mar. 19, 2020

Related U.S. Application Data

(60) Provisional application No. 62/731,161, filed on Sep. 14, 2018.

(51) Int. Cl.

| | |
|---|---|
| ***A63B 59/00*** | (2015.01) |
| ***A63B 69/00*** | (2006.01) |
| ***A63B 59/50*** | (2015.01) |
| *A63B 102/18* | (2015.01) |

(52) U.S. Cl.

CPC ..... *A63B 59/50* (2015.10); *A63B 2102/182* (2015.10)

(58) Field of Classification Search

CPC ..... A63B 59/55; A63B 59/50; A63B 59/56; A63B 60/54; A63B 60/04; A63B 43/00; A63B 69/0002; A63B 69/00; A63B 2102/182

USPC ..... 473/437, 457, 568, 519, 520, 567, 594, 473/595, 422

See application file for complete search history.

(56) References Cited

U.S. PATENT DOCUMENTS

| | | | | |
|---|---|---|---|---|
| 2,379,006 A * | 6/1945 | Johnson | A63B 59/55 | 473/568 |
| 3,116,926 A * | 1/1964 | Owen | A63B 59/50 | 473/457 |
| 3,136,546 A * | 6/1964 | Connolly | A63B 24/0062 | 473/234 |
| 3,877,698 A * | 4/1975 | Volpe | A63B 60/10 | 473/520 |
| 3,963,239 A * | 6/1976 | Fujii | A63B 59/50 | 473/519 |
| 3,990,699 A | 11/1976 | Urmston | | |
| 4,331,330 A | 5/1982 | Worst | | |

(Continued)

FOREIGN PATENT DOCUMENTS

KR 2003048970 A * 1/2005 ..... A63B 59/50

*Primary Examiner* — Mitra Aryanpour

(74) *Attorney, Agent, or Firm* — Husch Blackwell LLP

(57) ABSTRACT

An apparatus for a ball bat and a ball bat comprising at least one disc member that defines an outer diameter corresponding to an inner diameter defined by the ball bat to create a fit within close proximity between the at least one disc member and the ball bat. The at least one disc member can be located within the barrel portion of the ball bat. The at least one disc member can include at least one solid disc member that is located within a sweet spot of the ball bat. In some embodiments, the apparatus for a ball bat and the ball bat can further include an at least one insulation foam member. The at least one insulation foam member can separate the at least one disc member. The at least one insulation foam member can define a hollow center portion.

17 Claims, 8 Drawing Sheets

(56) References Cited

U.S. PATENT DOCUMENTS

| | | | | |
|---|---|---|---|---|
| 4,930,772 | A | 6/1990 | Maloney et al. | |
| 5,277,421 | A * | 1/1994 | Rewolinski | A63B 59/56 473/457 |
| 5,511,777 | A * | 4/1996 | McNeely | A63B 60/54 473/520 |
| 6,022,282 | A | 2/2000 | Kennedy et al. | |
| 6,176,795 | B1 | 1/2001 | Schullstrom | |
| 6,254,502 | B1 * | 7/2001 | Becker | A63B 60/04 473/594 |
| 6,280,353 | B1 * | 8/2001 | Brundage | A63B 15/00 473/457 |
| 6,398,675 | B1 | 6/2002 | Eggiman et al. | |
| 6,497,631 | B1 | 12/2002 | Fritzke et al. | |
| 6,663,517 | B2 | 12/2003 | Buiatti et al. | |
| 6,682,447 | B1 * | 1/2004 | Black | A63B 15/00 473/457 |
| 6,733,404 | B2 | 5/2004 | Fritzke et al. | |
| 6,761,653 | B1 | 7/2004 | Higginbotham et al. | |
| 6,949,038 | B2 | 9/2005 | Fritzke | |
| 7,014,580 | B2 | 3/2006 | Forsythe et al. | |
| 7,147,580 | B2 * | 12/2006 | Nutter | A63B 15/005 473/457 |
| 7,198,581 | B1 * | 4/2007 | Black | A63B 15/00 473/454 |
| 7,867,114 | B2 | 1/2011 | Sutherland et al. | |
| 8,182,377 | B2 | 5/2012 | Chuang et al. | |
| 8,197,366 | B2 | 6/2012 | Chauvin et al. | |
| 8,206,250 | B1 | 6/2012 | Cruz et al. | |
| 8,317,640 | B1 | 11/2012 | Cruz et al. | |
| 8,376,881 | B2 | 2/2013 | Chuang et al. | |
| 8,435,143 | B2 | 5/2013 | Vander Pol et al. | |
| 8,449,412 | B2 | 5/2013 | Vander Pol et al. | |
| 8,480,519 | B2 | 7/2013 | Chauvin et al. | |
| 8,506,429 | B2 | 8/2013 | Chauvin et al. | |
| 8,512,176 | B1 | 8/2013 | Mathew et al. | |
| 8,727,917 | B2 | 5/2014 | Vander Pol et al. | |
| 8,821,323 | B2 * | 9/2014 | Liu | A63B 69/0002 473/457 |
| 8,852,037 | B2 | 10/2014 | Epling et al. | |
| 8,858,373 | B2 | 10/2014 | Epling et al. | |
| 8,888,614 | B2 * | 11/2014 | Nutter | A63B 69/0002 473/457 |
| 9,498,830 | B1 | 11/2016 | Robinson et al. | |
| 9,669,277 | B1 | 6/2017 | Haas et al. | |
| 2002/0016230 | A1 | 2/2002 | Okuyama et al. | |
| 2002/0091022 | A1 | 7/2002 | Fritzke et al. | |
| 2005/0070384 | A1 | 3/2005 | Fitzgerald et al. | |
| 2010/0160095 | A1 | 6/2010 | Chauvin et al. | |
| 2011/0152015 | A1 | 6/2011 | Burger | |
| 2013/0165279 | A1 | 6/2013 | Chuang et al. | |
| 2013/0274039 | A1 | 10/2013 | Chauvin et al. | |
| 2014/0206483 | A1 | 7/2014 | Goodwin et al. | |
| 2014/0206484 | A1 | 7/2014 | Goodwin et al. | |
| 2014/0206485 | A1 | 7/2014 | Goodwin et al. | |
| 2014/0342856 | A1 | 11/2014 | Chauvin et al. | |
| 2015/0273295 | A1 | 10/2015 | Haas et al. | |
| 2018/0021646 | A1 | 1/2018 | O'Hara et al. | |

* cited by examiner

BAT HAVING AT LEAST ON DISC ALONG THE LENGTH OF THE BAT BARREL

CROSS-REFERENCE TO RELATED APPLICATIONS

This application claims priority to U.S. Provisional Patent Application No. 62/731,161, filed Sep. 14, 2018, to Peter Wiese, entitled "Bat with Discs in Its Barrel Portion,". The entire disclosure, including the specification and drawings, of the above-referenced application is incorporated herein by reference.

FIELD OF INVENTION

The present invention relates generally to a ball bat for use in diamond sports such as baseball and softball. More particularly, the present invention relates to a ball bat having a plurality of disc members located between its tapered portion and its distal portion. The disc members of the ball bat's barrel portion reduce performance in certain locations but preferably maintain a relatively low ball bat weight.

BACKGROUND OF INVENTION

Numerous attempts have been made to improve the performance of a ball bat used in diamond sports like baseball and softball. These prior attempts have included the addition of various shells, inserts, materials, and shapes of the ball bat in order to improve its performance or usage. For example, U.S. Pat. Nos. 9,669,277, 9,498,830, 8,512,176, 8,317,640, 8,206,250, 7,867,114, 7,014,580, 6,949,038, 6,761,653 6,733,404, 6,663,517, 6,497,631, 6,398,675, 6,176,795, 6,022,282, 4,930,772, 4,331,330, and 3,990,699, and U.S. Patent Application Publication Nos. 2002/0016230, 2002/0091022, 2005/0070384, 2010/0160095, 2011/0152015, 2013/0274039, 2013/0165279, 2015/0273295, and 2018/0021646 disclose various attempts to improve the performance or use of a ball bat.

The performance of a ball bat is generally based upon the weight of the ball bat, length of the ball bat, and the impact response of the ball bat at and during impact with a ball. Most of the focus for improvements in ball bat technology has been in improving the performance of the preferred impact area, or "sweet spot" of the ball bat. The sweet spot may be many inches in length, depending on the construction of the ball bat. The sweet spot generally includes a point of maximum performance, at which a batted ball leaves the ball bat with the highest exit velocity compared to the rest of the sweet spot of the ball bat. The point of maximum performance is often approximately four to eight inches, and usually five to seven inches, from the end cap end of the ball bat's barrel portion.

As the prior art ball bats have increased the performance in this area, many sports regulatory agencies have placed performance and/or configuration restrictions on the ball bats. For example, most regulatory bodies set a maximum performance level of a ball bat when a ball impacts the point of maximum performance of that ball bat, even as the ball bat "breaks in" during use. Typically, this impact performance level is measured by the exit velocity of the ball off the ball bat right after impact. Additionally, ball bats must break at a certain point during testing (e.g., accelerated break in rolling testing) in order to pass tests imposed by sports regulatory agencies. As ball bats tend to increase in performance as they "break in," some competitors sacrifice much of the lifetime of the ball bat by intentionally aging or damaging their ball bats to increase performance. Sports regulatory agencies therefore often test ball bats by "rolling" them through rollers that exert high pressures. Ball bats must fully fail during these tests to show that artificial aging/damaging techniques would not be effective.

To create ball bats that meet the reduced performance level requirements, many ball bat makers have added stiffer materials within ball bats' barrel portions. As a result, it became harder to make ball bats of a weight and length that players are accustomed to. Many ball bats are categorized for consumers by their "weight drop." Simply put (although different regulatory agencies may measure weight drop differently), a weight drop may be characterized as the difference between weight and length of a ball bat. For example, a 32-inch ball bat having a weight of 20 ounces has a −12 weight drop, while a 29-inch ball bat weighing 24 ounces has a −5 weight drop. The majority of ball bats have a weight drop between −5 and −12. Ball bats with greater weight drops (e.g., −12) are often viewed as more desirable, but they are also harder to make when stiff, heavy material is added to the ball bat's barrel portion in order to reduce its performance for purposes of satisfying requirements imposed by sports regulatory agencies.

SUMMARY OF THE INVENTION

Disclosed herein are an apparatus and a system for a ball bat for striking a ball. The apparatus can comprise a ball bat, at least one disc member, and at least one insulation foam member. The ball bat can comprise a barrel portion and an inner wall disposed within the ball bat. The at least one disc member can comprise at least one solid disc member and define a first outer diameter. The at least one insulation foam member can define a second outer diameter. The barrel portion of the ball bat can define an inner diameter. The first outer diameter of the at least one disc member may correspond with the inner diameter of the ball bat to create a fit within close proximity (e.g., a friction fit) between the at least one disc member and the ball bat. The second outer diameter of the at one least insulation foam member may also correspond with the inner diameter of the ball bat. This may create a fit within close proximity (e.g., a friction fit) between the at least one insulation foam member and the ball bat. In one embodiment, the at least one disc member can be in friction fit with the inner wall of the ball bat. In another embodiment, the at least one insulation foam member is in friction fit with the inner wall of the ball bat. The insulation foam member may include a hollow center portion. The at least one disc member has a thickness of about 0.125 inches, and the at least one insulation foam member has a height of about 1.5 inches.

The apparatus can be installed using a method comprising the steps of alternatingly inserting the at least one disc member and the at least one insulation foam member into the barrel portion of the ball bat, providing slight pressure in a proximal direction relative to the ball bat to the at least one disc member and the at least one insulation foam member, and inserting an end cap into an opening defined by the barrel portion of the ball bat.

The ball bat generally comprises a barrel portion and a distal portion and at least one disc member that is disposed within the barrel portion of the ball bat. The barrel portion may define an inner diameter, the at least one disc member may define an outer diameter, and the outer diameter of the at least one disc member may correspond with the inner diameter of the barrel portion of the ball bat to create a fit therewith. In one embodiment, the barrel portion can further comprise an inner wall member, the at least one disc member can comprise an outer circumference, and the inner wall member of the barrel portion and the outer circumference of the at least one disc member can correspond to create a friction fit. The system for a ball bat can also comprise at least one insulation foam member. In one embodiment, the at least one disc member can comprise at least one solid disc member, and the at least one solid disc member can be located within a preferred impact area, or "sweet spot," of the ball bat. The at least one solid disc member can be located within the barrel portion of the ball bat between about 5 to 7 inches from the distal portion of the ball bat.

In another embodiment of the system for a ball bat, the at least one disc member can comprise at least two disc members. The at least two disc members can comprise at least two solid disc members, and the at least two solid disc members can be located within a sweet spot of the ball bat. In yet another embodiment, the system for a ball bat can further comprise at least one insulation foam member, wherein the at least one insulation foam member separates the at least two solid disc members. The at least two disc members and the at least one insulation foam member can be concentrically aligned. Further, the at least two solid disc members can be located within the barrel portion of the ball bat between about 5 to 7 inches from the distal portion of the ball bat. In a further embodiment, the ball bat can further comprise a tapered portion, and the at least one disc member can be located substantially where the tapered portion of the ball bat and the barrel portion of the ball bat meet. Further, the at least one disc member can be a non-solid disc member. The at least one disc member can be located about 8.75 inches from the distal portion of the ball bat.

DESCRIPTION OF THE DRAWINGS

For a better understanding of the various embodiments of the present invention, reference may be made to the accompanying drawings in which.

Figure 1:
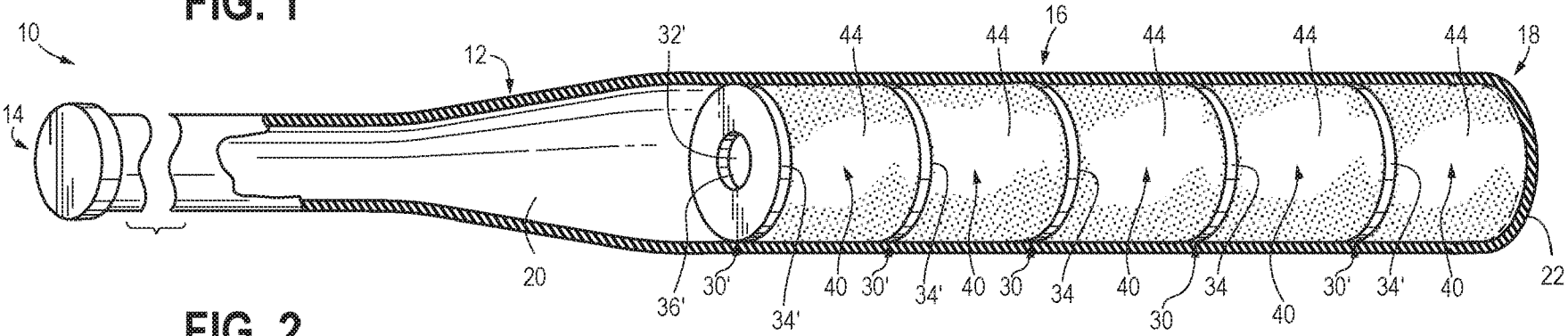
FIG. 1 is a partial cross sectional view of an exemplary ball bat with disc members and insulation foam members in the barrel portion of the ball bat constructed in accordance with embodiments presented herein.

While the disclosure is susceptible to various modifications and alternative forms, a specific embodiment thereof is shown by way of example in the drawings and will herein be described in detail. It should be understood, however, that the drawings and detailed description presented herein are not intended to limit the disclosure to the particular embodiment disclosed, but to the contrary, the intention is to cover all modifications, equivalents, and alternatives falling within the spirit and scope of the present disclosure as defined by the appended claims.

DETAILED DESCRIPTION OF THE INVENTION

The invention will now be described with reference to the drawing figures, in which like reference numerals refer to like parts throughout. For purposes of clarity in illustrating the characteristics of the present invention, proportional relationships of the elements have not necessarily been maintained in the drawing figures.

Figure 2:
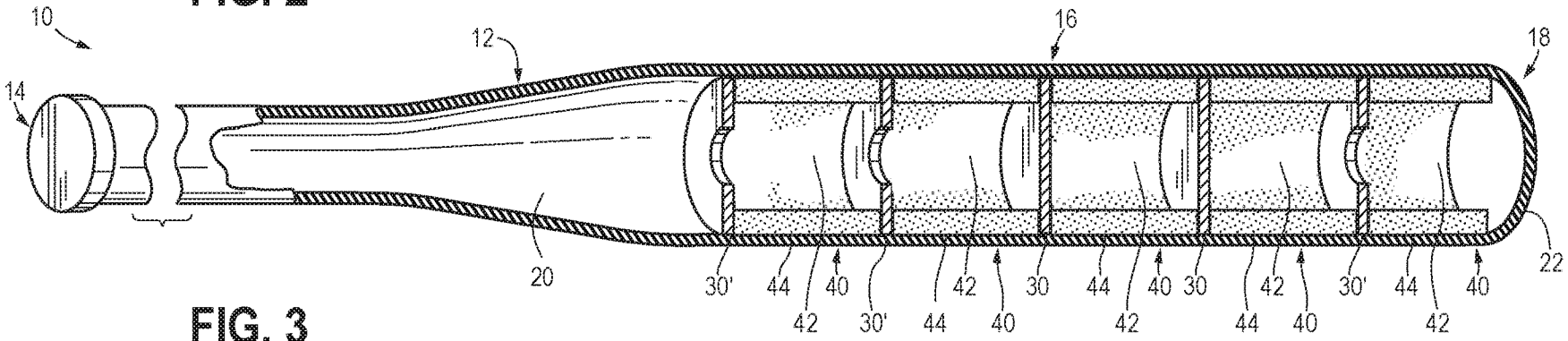
FIG. 2 is a cross sectional view of the ball bat of FIG. 1.
Figure 3:
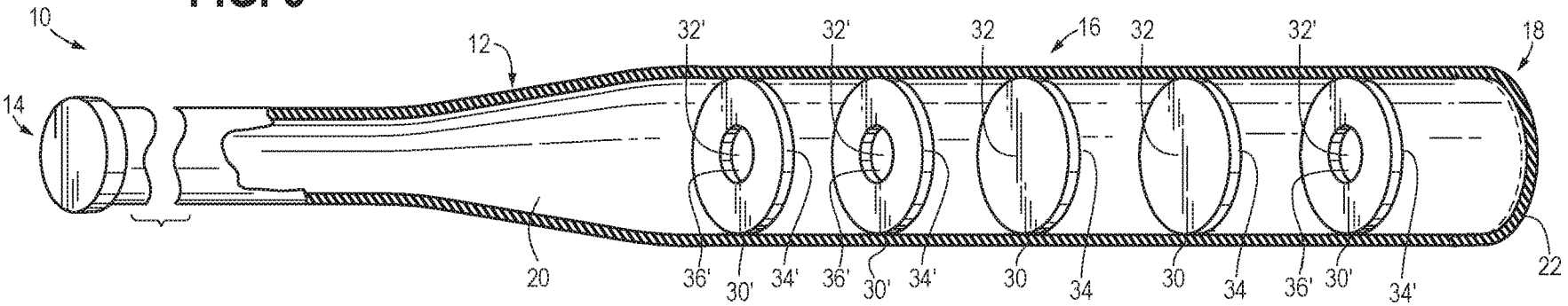
FIG. 3 is an alternative partial cross sectional view of the ball bat of FIG. 1.

Referring to the drawings, FIGS. 1-3 illustrate a ball bat 10, the components and construction of which will be described hereinbelow. As shown in FIGS. 1-3, like other prior art ball bats known and understood in the art that are used in diamond sports like baseball or softball, the ball bat 10 can comprise a tapered portion 12 (preferably located near a proximal portion 14 of the ball bat 10) and a barrel portion 16 (preferably located near a distal portion 18 of the ball bat 10), as illustrated. The barrel portion 16 of the ball bat 10 can define an opening (not shown) provided at the distal portion 18 of the ball bat 10, which can be provided during manufacturing of the ball bat 10. Further, as illustrated in FIGS. 1-3, the tapered portion 12 and the barrel portion 16 of the ball bat 10 can preferably share an inner wall member 20 of the inner diameter of the ball bat 10. Like prior art ball bats, the barrel portion 16 is preferably located at the portion of the ball bat 10 that strikes a ball (not shown) when the ball bat 10 is used.

As best illustrated in FIGS. 1-3, in accordance with a preferred embodiment of the present invention, the barrel portion 16 of the ball bat 10 may comprise a plurality of solid and continuous disc members 30 and a plurality of non-solid disc members 30' disposed along the interior of the barrel portion 16 of the ball bat 10. Each solid disc member 30 may generally comprise a center portion 32 and an outer circumference 34, and each non-solid disc member 30' may generally comprise a center portion 32', an outer circumference 34', and at least one hole 36' preferably located in its center portion 34'. The purpose of the at least one hole 36' will be described in greater detail hereinbelow. In a preferred embodiment, the plurality of solid disc members 30 and the plurality of non-solid disc members 30' can be preferably made of a carbon fiber. As recognized in the art, the use of solid disc members 30 and non-solid disc members 30' comprising carbon fiber can result in greater batted ball speed, and thus for ball bats where batted ball speed needs to be reduced to conform with regulations, carbon fiber disc members 30 and non-solid disc members 30' may be utilized. However, it will be understood that the plurality of disc members 30 and the plurality of non-solid disc members 30' can be made of polycarbonate, aluminum, thermoplastic composite materials, or any other suitable materials, and any combination thereof.

The outer circumferences 34, 34' of the disc members 30, 30' can generally define outer diameters D1, D1' of the disc members 30, 30' that can correspond with an inner diameter of the ball bat 10 defined by the inner wall member 20. In a preferred embodiment, when a disc member 30, 30' is inserted into the barrel portion 16 of the ball bat 10, the correspondence between the outer diameter D1, D1' of the disc member 30, 30' and the inner diameter of the ball bat 10 can create a fit within close proximity between the disc member 30, 30' and the corresponding location of the barrel portion 16 of the ball bat 10. For example, in one embodiment of the present invention, the plurality of disc members 30, 30' can be in friction fit with the inner wall member 20 of the ball bat 10, such that the plurality of disc members 30, 30' is firmly stabilized within the barrel portion 16 of the ball bat 10.

As further illustrated in FIGS. 1-2, the barrel portion 16 of the ball bat 10 may further comprise a plurality of insulation foam members 40 disposed along the interior of the barrel portion 16 of the ball bat 10, wherein each insulation foam member 40 may generally comprise a center portion 42 and an outer circumference 44. In a preferred embodiment, an insulation foam member 40 can be formed as an annular cylinder such that the center portion 42 of an insulation foam member 40 can be substantially hollow having a particular density, and can define a radial thickness R. An insulation foam member 40 can include a substantially hollow center portion 42 so that the insulation foam member 40 does not reduce the performance of the ball bat 10 to a degree greater than necessary to obtain regulatory compliance. In a preferred embodiment, the plurality of insulation foam members 40 are made of pipe insulation foam. However, it will be understood that the plurality of insulation foam members 40 can be made of polyethylene foams, cross-linked polyethylene foams, polyurethane foams, reticulated polyurethane foams, specialty foams or any other suitable materials, and any combination thereof. The outer circumference 44 of each insulation foam member 40 can generally define an outer diameter D2 of the insulation foam members 40 that can correspond with an inner diameter of the ball bat 10 defined by the inner wall member 20.

In a preferred embodiment, when an insulation foam member 40 is inserted into the barrel portion 16 of the ball bat 10, the correspondence between the outer diameter D2 of the insulation foam member 40 and the inner diameter of the ball bat 10 can create a fit within close proximity between the insulation foam member 40 and the corresponding location of the barrel portion 16 of the ball bat 10. For example, in one embodiment of the present invention, the plurality of insulation foam members 40 can be in friction fit with the inner wall member 20 of the ball bat 10, such that the plurality of insulation foam members 40 is firmly stabilized within the barrel portion 16 of the ball bat 10.

In a preferred embodiment, and as best illustrated in FIGS. 1 and 2, the plurality of disc members 30, 30' and the plurality of insulation foam members 40 can be alternatingly inserted into the barrel portion 16 of the ball bat 10. Thus, each insulation foam member 40 may generally separate adjacent disc members 30, 30' from one another. For example, a first non-solid disc member 30' can be preferably placed nearest the proximal portion 14 of the ball bat 10. The first non-solid disc member 30' is preferably located substantially where the tapered portion 12 and the barrel portion 16 of the ball bat 10 meet or abut one another.

When the first non-solid disc member 30' is inserted into the ball bat 10, the outer circumference 34 of the first non-solid disc member 30' may substantially abut the inner wall member 20 of the ball bat 10. In one embodiment of the present invention, the abutment of the outer circumference 34 of the first non-solid disc member 30' with the inner wall member 20 of the ball bat 10 may create a friction fit, such that the first non-solid disc member 30' is firmly stabilized near the intersection of the tapered portion 12 and the barrel portion 16 of the ball bat 10. When the first non-solid disc member 30' is inserted into the ball bat 10 and is friction fit, the first non-solid disc member 30' can be substantially perpendicular to the barrel portion 16 of the ball bat 10. The first non-solid disc member 30' can be located between about 3 and 12 inches from distal portion 18 of the ball bat 10 in one embodiment, between 4.5 and 10.5 inches from distal portion 18 of the ball bat 10 in another embodiment, between 6 and 9 inches from distal portion 18 of the ball bat 10 in yet another embodiment, and about 8.75 inches from distal portion 18 of the ball bat 10 in a further embodiment. However, it will be understood that, as described below, the distance and spacing of plurality of disc members 30, 30' within the barrel portion 16 of the ball bat 10 may vary depending on size and performance requirements of the ball bat 10.

After the first non-solid disc member 30' is inserted into the barrel portion 16 of the ball bat 10, a first insulation foam member 40 may be inserted into the barrel portion 16 of the ball bat 10. As illustrated in FIGS. 1-2, the first insulation foam member 40 can be preferably located adjacent to and on the distal side of the first non-solid disc member 30' and substantially abut the first non-solid disc member 30'. The first insulation foam member 40 can be positioned such that when a second non-solid disc member 30' is inserted into the ball bat 10, the second non-solid disc member 30' can be pushed toward the proximal portion 14 of the ball bat 10 until the second non-solid disc member 30' substantially abuts the first insulation foam member 40. Because the first non-solid disc member 30' is preferably stably and securely fixed within the ball bat 10, the second non-solid disc member 30' may be pushed downwardly until the first insulation foam member 40 is somewhat compressed without dislodging the first disc member 30'. In a preferred embodiment, the above-described insertion process can be repeated for a series of alternating plurality of disc members 30, 30' and plurality of insulation foam members 40 over the entire length of the barrel portion 16 of the ball bat 10.

In an embodiment of the present invention, when the first insulation foam member 40 is inserted into the ball bat 10, the outer circumference 44 of the first insulation foam member 40 may abut the inner wall member 20 of the ball bat 10. The outer circumference 44 of the first insulation foam member 40 abutting the inner wall member 20 of the ball bat 10 may preferably create a friction fit, such that the first insulation foam member 40 is firmly stabilized near the first non-solid disc member 30' within the barrel portion 16. When the first insulation foam member 40 is inserted into the ball bat 10 and is friction fit, the first insulation foam member 40 may be substantially perpendicular to the barrel portion 16 of the ball bat 10. The first insulation foam member 40 can be located between about 2 and 11 inches from distal portion 18 of the ball bat 10 in one embodiment, between 3.5 and 9.5 inches from distal portion 18 of the ball bat 10 in another embodiment, between 5 and 8 inches from distal portion 18 of the ball bat 10 in yet another embodiment, and about 7.5 inches from distal portion 18 of the ball bat 10 in a further embodiment. However, it will be understood that, as described below, the distance and spacing of plurality of insulation foam members 40 within the barrel portion 16 of the ball bat 10 may vary depending on size and performance requirements of the ball bat 10.

The plurality of disc members 30, 30' and the plurality of insulation foam members 40 can be alternatingly inserted into the barrel portion 16 of the ball bat 10 in series such that alternating disc members 30, 30' are located generally adjacent to the alternating insulation foam members 40. In one embodiment, after the final insulation foam member 40 has been inserted into the barrel portion 16 of the ball bat 10, an end cap 22, which may be substantially similar to those known and understood in the art, may be inserted via friction fit into the opening provided at the distal portion 18 of the ball bat 10. The end cap 22 may close the opening and preferably apply a slight pressure in a proximal direction to the plurality of disc members 30, 30' and the plurality of insulation foam members 40 disposed within the barrel portion 16 of the ball bat 10. Thus, the plurality of disc members 30, 30' and the plurality of insulation foam members 40 are static within the ball bat 10. In using the above-described assembly method, in a preferred embodiment, manufacturing is driven by a number of friction fit securements and is a fairly simple process. In alternative embodiments, glues or other adhesives may be used to secure the plurality of disc members 30, 30' and the plurality of insulation foam members 40 within the ball bat 10.

In one embodiment, the series of alternating plurality of disc members 30, 30' and plurality of insulation foam members 40 can comprise five disc members 30, 30' that are concentrically aligned. In another embodiment, the series of alternating plurality of disc members 30, 30' and plurality of insulation foam members 40 can comprise five insulation foam members 40 that are concentrically aligned. In yet another embodiment, the number of disc members 30, 30' comprising the series of alternating plurality of disc members 30, 30' and plurality of insulation foam members 40 can correspond with or equal the number of insulation foam members 40 comprising the series of alternating plurality of disc members 30, 30' and plurality of insulation foam members 40. However, it will be understood that the series of alternating plurality of disc members 30, 30' and plurality of insulation foam members 40 can comprise any suitable number of disc members 30, 30' and insulation foam members 40, and may or may not be equal or correspond in number to one another.

The series of the plurality of disc members 30, 30' can comprise solid disc members 30 and non-solid disc members 30'. Solid disc members 30 can be located at a preferred impact area or portion of the ball bat 10 known as the sweet spot to satisfy regulations that have been placed on ball bats to reduce batted ball speed. The sweet spot generally includes a point of high performance, at which a batted ball leaves the ball bat 10 with the highest exit velocity compared to other portions of the ball bat 10, and the resulting sensation on a batter's hands is lessened. The point of maximum performance is often approximately 4 to 8 inches, and usually 5 to 7 inches, from the distal portion 18 of the ball bat 10.

In another embodiment, non-solid disc members 30' can be introduced at non-sweet spot locations of the ball bat 10. At the non-sweet spot locations, the natural performance of the ball bat 10 and batted ball speed produced thereby is lower than in the sweet spot. Thus the non-solid disc members 30' are used in the non-sweet spot locations because regulations may not require balls that are struck in those non-sweet spot locations to be reduced to the same degree as balls that are struck in the sweet spot. As known and understood in the art, and as a matter of physics principals, because the non-solid disc members 30' include some degree of elasticity, batted balls that are struck off of portions of the ball bat 10 corresponding with the non-solid disc members 30' have a greater batted ball speed than batted balls that are struck off of portions of the ball bat 10 corresponding with the solid disc member 30.

As best illustrated in FIG. 3, a first non-solid disc member 30' can be located closest to the proximal portion 14 of the ball bat 10. A second non-solid disc member 30' can be located near the proximal portion 14 of the ball bat 10 and distal of the first non-solid disc member 30'. A first solid disc member 30 can be located distal of the second non-solid disc member 30' and generally within the sweet spot of the ball bat 10. A second solid disc member 30 can be located near the distal portion 18 of the ball bat 10 and distal of the first solid disc member 30 while also being generally within the sweet spot of the ball bat 10. A third non-solid disc member 30' can be located closest to the distal portion 18 of the ball bat 10. In one embodiment, the first solid disc member 30 and the second solid disc member can be placed 7 inches and 6 inches, respectively, from the distal portion 18 of the ball bat 10. It will be understood that the series of the plurality of disc members 30, 30' can include any arrangement of solid disc members 30 and non-solid disc members 30'. It will be further understood that a plurality of insulation foam members (not shown) may be located between and adjacent to the plurality of disc members 30, 30' illustrated in FIG. 3.

Figure 4:
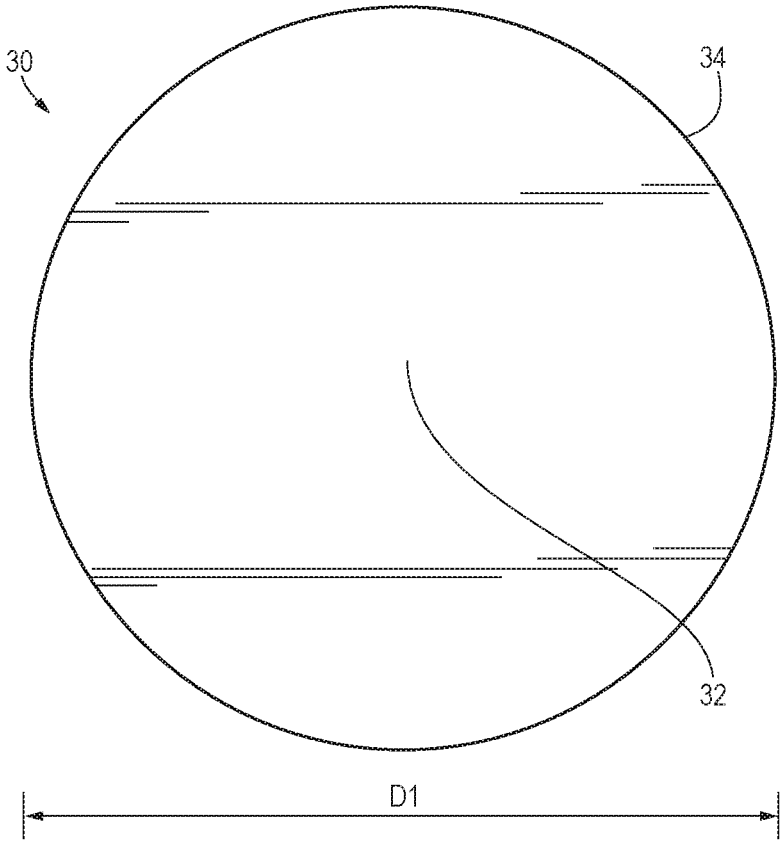
FIG. 4 is a plan view of an exemplary solid disc member in accordance with embodiments presented herein.
Figure 5:
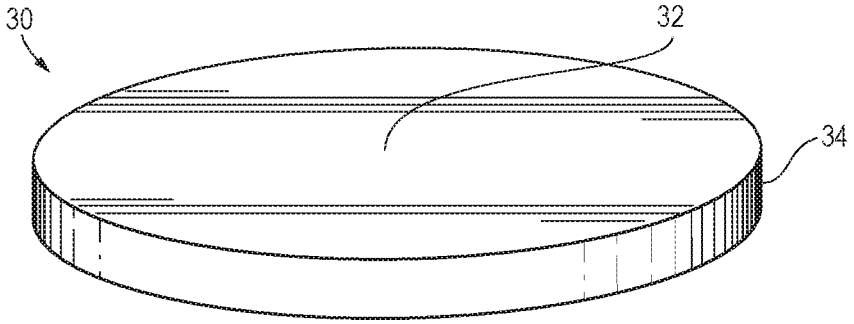
FIG. 5 is a perspective view of the solid disc member of FIG. 4.

FIGS. 4-5 illustrate an exemplary solid disc member 30. The exemplary solid disc member 30 may be an example of the solid disc members 30 shown and illustrated in FIGS. 1-3. FIGS. 6-11 illustrate various embodiments of non-solid disc members 30', 30", 30'". The various embodiments non-solid disc members 30', 30", 30'" may be examples of the non-solid disc members 30' shown and illustrated in FIGS. 1-3. As best illustrated in FIGS. 4-11, the plurality of disc members 30, 30', 30", 30'" can have outer diameters D1, D1', D1", D1'" that can each be between about 1.5 and 3.5 inches in one embodiment, between 2 and 2.75 inches in another embodiment, and about 2.384 inches in yet another embodiment. However, it will be understood that the outer diameters D1, D1', D1", D1'" of the plurality of disc members 30, 30', 30", 30'" may vary depending on the size and performance requirements of any given ball bat.

Figure 6:
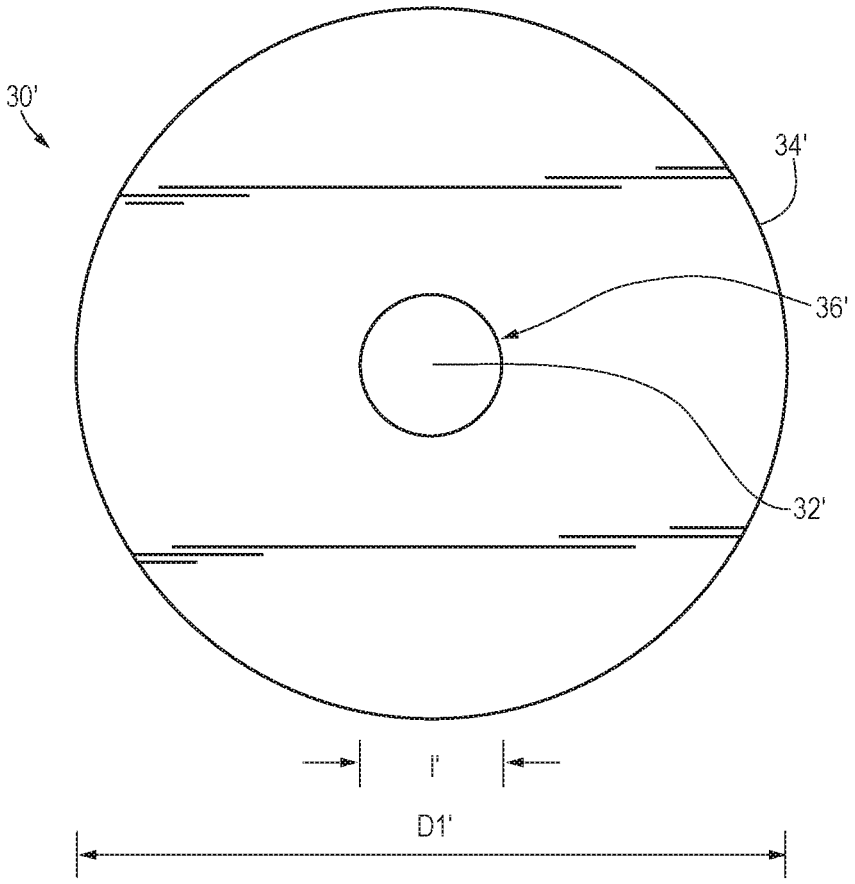
FIG. 6 is a plan view of an exemplary non-solid disc member in accordance with embodiments presented herein.
Figure 7:
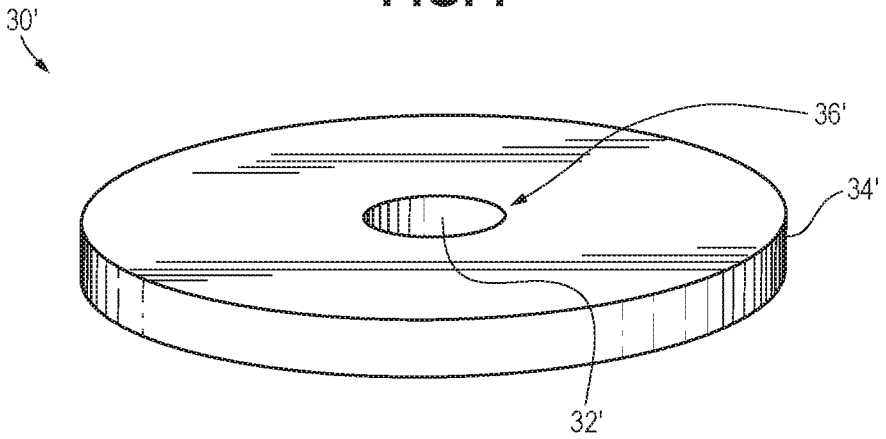
FIG. 7 is a perspective view of the non-solid disc member of FIG. 6.
Figure 8:
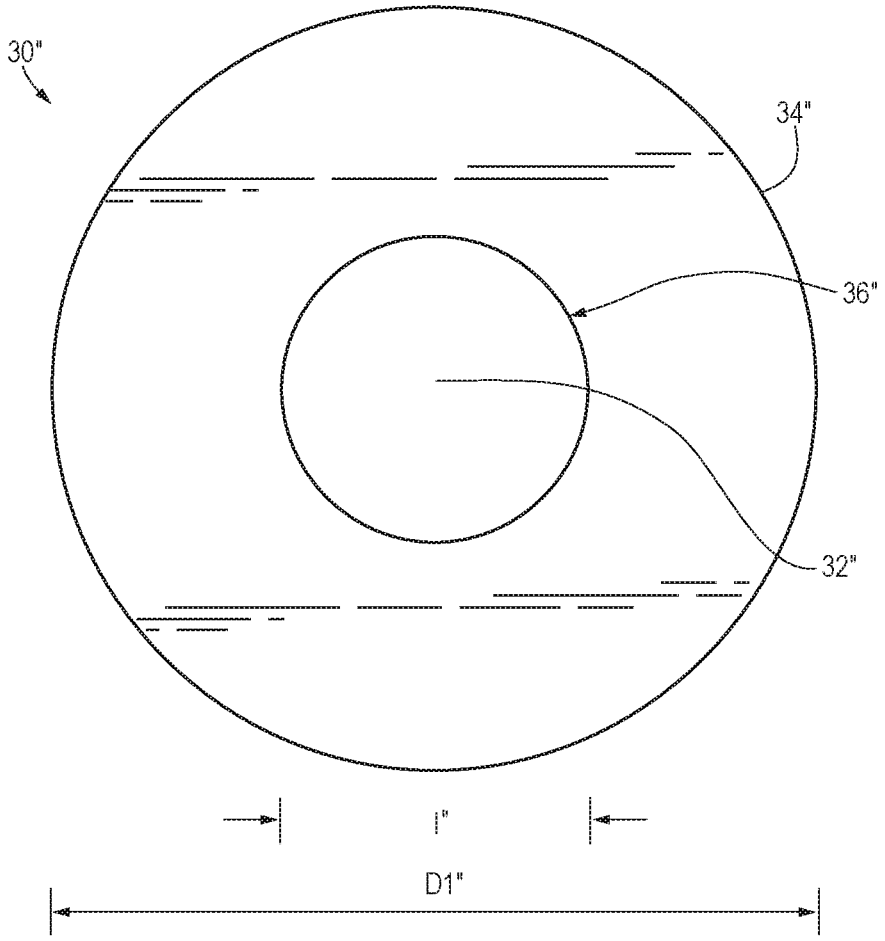
FIG. 8 is a plan view of another exemplary non-solid disc member in accordance with embodiments presented herein.
Figure 9:
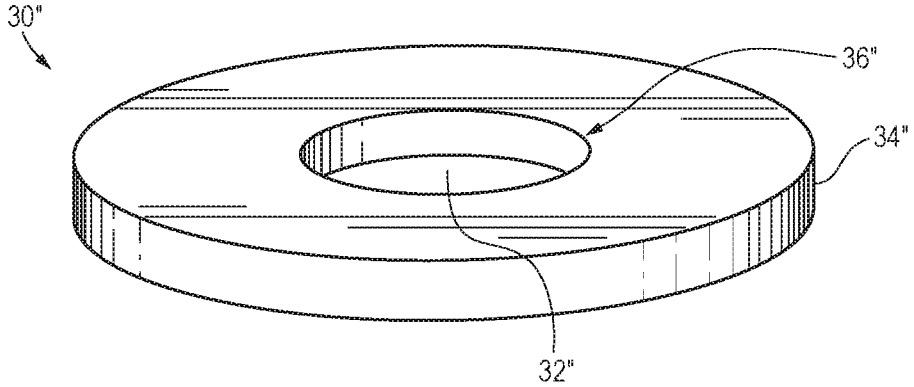
FIG. 9 is a perspective view of the non-solid disc member of FIG. 8.
Figure 10:
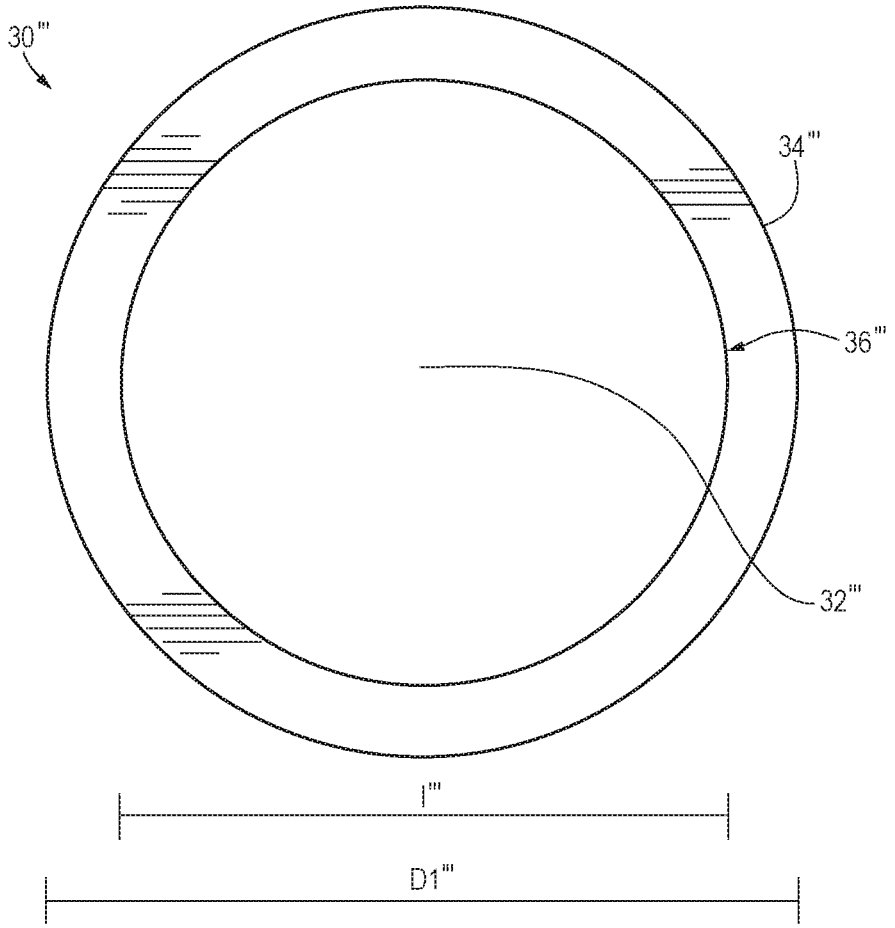
FIG. 10 is a plan view of yet another exemplary non-solid disc member in accordance with embodiments presented herein.
Figure 11:
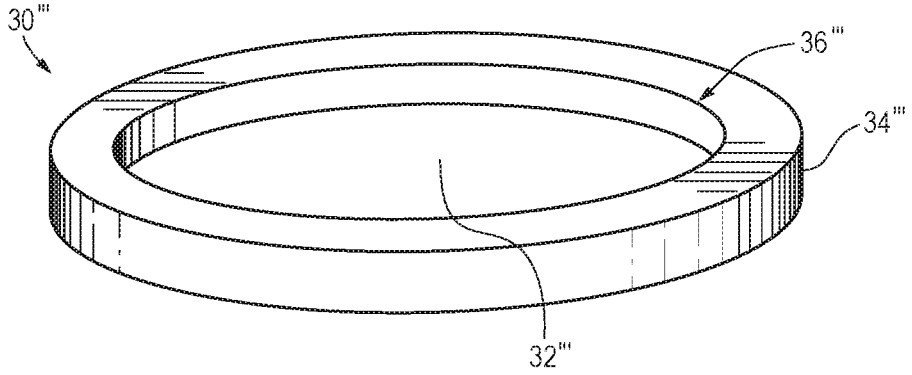
FIG. 11 is a perspective view of the non-solid disc member of FIG. 10.

FIGS. 6-7 illustrate an embodiment of an exemplary non-solid disc member 30', which may generally comprise a center portion 32', an outer circumference 34', and at least one hole 36' preferably located in its center portion 34'. FIGS. 8-9 illustrate another embodiment of an exemplary non-solid disc member 30", which may generally comprise a center portion 32", an outer circumference 34", and at least one hole 36" preferably located in its center portion 34". FIGS. 10-11 illustrate yet another embodiment of an exemplary non-solid disc member 30'", which may generally comprise a center portion 32'", an outer circumference 34'", and at least one hole 36' preferably located in its center portion 34'".

As best illustrated in FIGS. 6-11, the inner diameters I', I", I'" of the at least one holes 36', 36", 36'" of the non-solid disc members 30', 30", 30'" can vary in size depending on the size and performance requirements of any given ball bat. For example, the inner diameters I', I", I'" of the at least one hole 36', 36", 36'" in the non-solid disc members 30', 30", 30'" can be between about 0.125 and 2 inches in one embodiment, between 0.5 and 1.5 inches in another embodiment, and about 1 inch in yet another embodiment.

Figure 12:
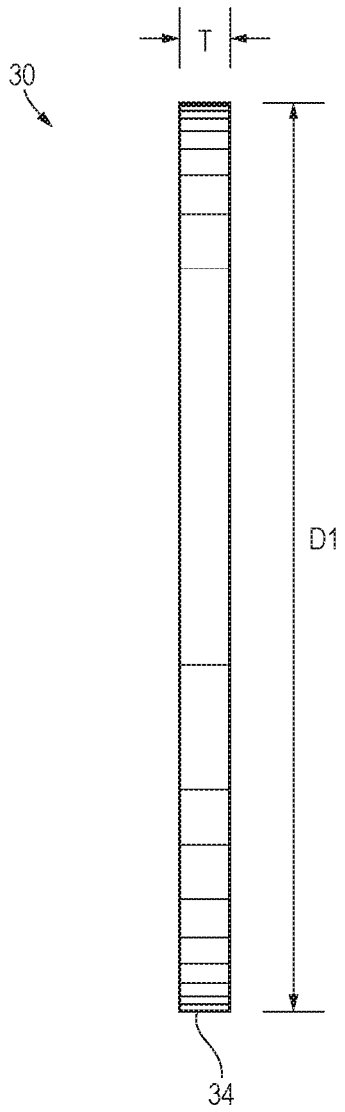
FIG. 12 is an elevation side view of exemplary disc members of FIGS. 4-11.

As shown in FIG. 12, the solid disc members 30 can have a thickness T between about 0.05 and 1.5 inches in one embodiment, between 0.1 and 0.75 inches in another embodiment, and about 0.125 inches in yet another embodiment. However, it will be understood that the thickness T of the solid disc members 30 may vary depending on the size and performance requirements of any given ball bat. Further, it will be understood that FIG. 12 may illustrate non-solid disc members 30', 30", 30'" and their respective thicknesses (not shown), which can also be between about 0.05 and 1.5 inches in one embodiment, between 0.1 and 0.75 inches in another embodiment, and about 0.125 inches in yet another embodiment.

It should be noted that in the illustrated embodiments of FIGS. 4-12, and as described herein, the disc members 30, 30', 30", 30'" are described as being a particular size, material, and spacing relative to one another. The thicknesses of the various disc members 30, 30', 30", 30'" preferably provides stiffness while keeping the overall weight in the ball bat 10 relatively low. Furthermore, the lower weight of disc members 30, 30', 30", 30'" preferably allows for multiple disc members 30, 30', 30", 30'" to be spread throughout the length of the barrel portion 16 of the ball bat 10. Not only does this preferably provide the proper performance governing the ball bat 10, but it also provides uniform durability throughout the length of the barrel portion 16 of the ball bat 10.

In a preferred embodiment of the present invention, manufacturing is also preferably simplified because one outer barrel shell of a ball bat 10 can produce a large variation on final products and models depending in part on how many disc members 30, 30' are inserted in the barrel portion 16 of the ball bat 10 and how long the barrel portion 16 is produced.

It should also be noted that the inclusion of disc members 30, 30' along the barrel portion 16 of the ball bat 10 preferably create stress concentrations and abrupt changes in the stiffness along the length of the ball bat 10 such that the ball bat 10 can break during accelerated break in testing that is known and understood in the art. A ball bat such as the ball bat 10 disclosed herein can break during such testing and may help to allow the ball bat to ultimately pass required certification testing. The abrupt changes in stiffness help the ball bat 10 to break after exposure to ABI compression/rolling testing.

Figure 13:
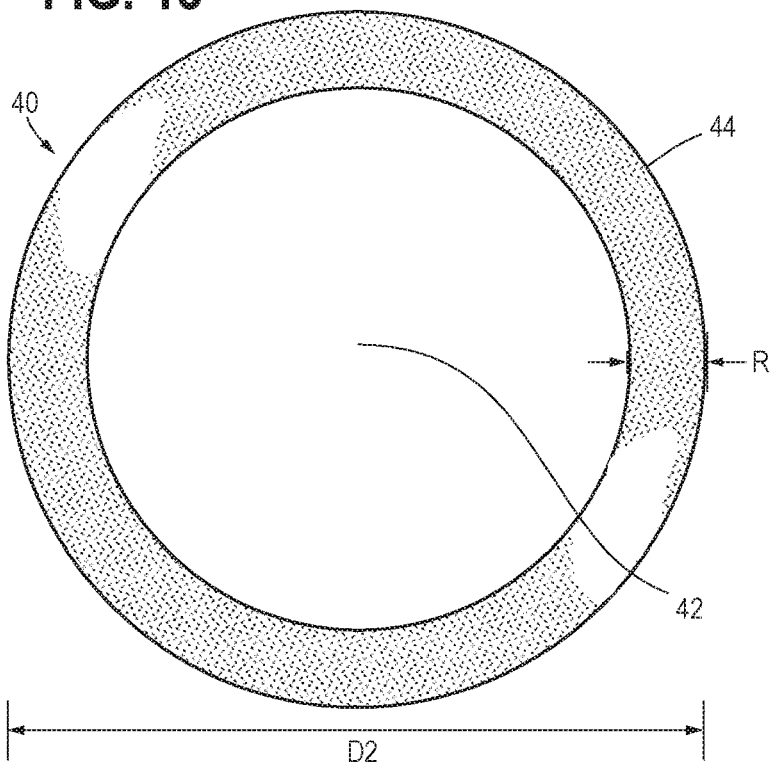
FIG. 13 is a plan view of an exemplary insulation foam member in accordance with embodiments presented herein.
Figure 14:
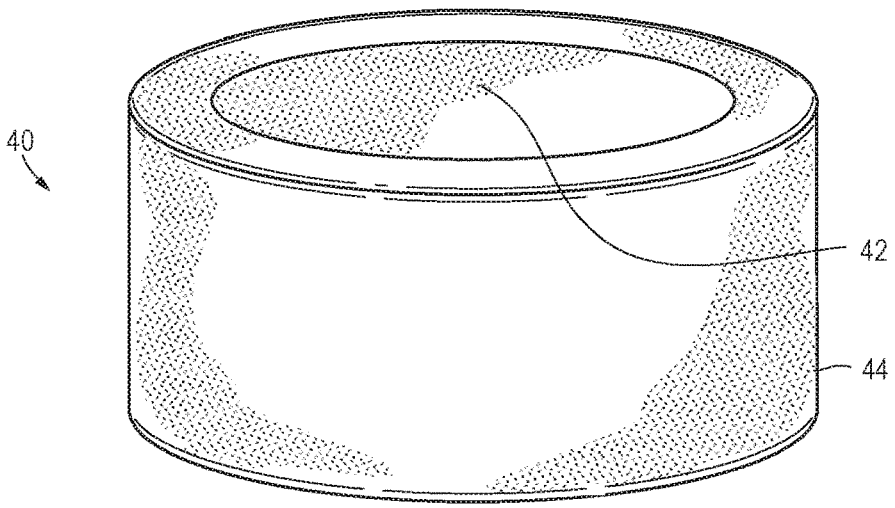
FIG. 14 is a perspective view of the insulation foam member of FIG. 13.
Figure 15:
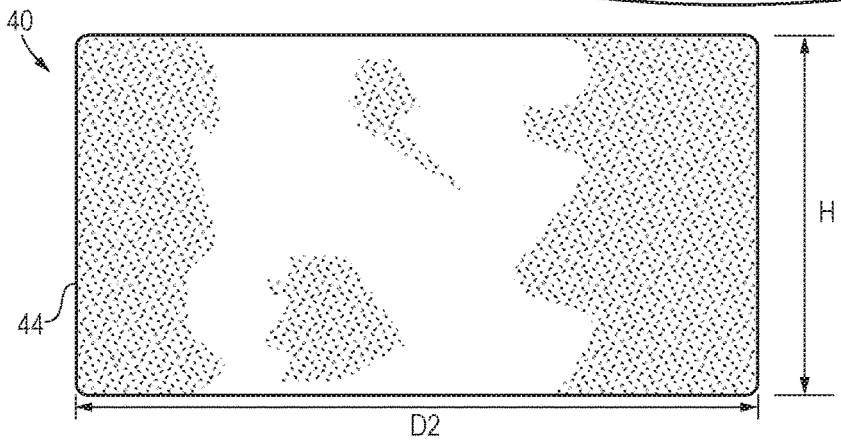
FIG. 15 is an elevation side view of the insulation foam member of FIGS. 13 and 14.

FIGS. 13-15 illustrate an exemplary insulation foam member 40 in accordance with a preferred embodiment of the present invention. As best illustrated in FIG. 13, the insulation foam members 40 can have an outer diameter D2 between about can be between about 1.5 and 3.5 inches in one embodiment, between 2 and 2.75 inches in another embodiment, and about 2.384 inches in yet another embodiment. Further, as best illustrated in FIG. 13, the insulation foam members 40 can have a radial thickness R between about can be between about 0.1 inches and 1 inch in one embodiment, between 0.2 and 0.7 inches in another embodiment, and about 0.5 inches in yet another embodiment. Further yet, as best illustrated in FIG. 15, the insulation foam members 40 can have varying longitudinal heights H (as defined by the length from the proximal portion to the distal portion of an individual insulation foam member 40), such that the insulation foam members 40 can separate adjacent disc members 30 by longitudinal height H.

In a preferred embodiment, the longitudinal height H of the insulation foam members 40 can be between about 0.5 inches and 3 inch in one embodiment, between 0.75 and 2 inches in another embodiment, and about 1.5 inches in yet another embodiment. However, it will be understood that the outer diameter D2, the radial thickness R, and the longitudinal height H of the insulation foam members 40 may vary depending on the size and performance requirements of any given ball bat. As best illustrated in FIG. 14, an insulation foam member 40 can be formed as an annular cylinder.

Figure 16:
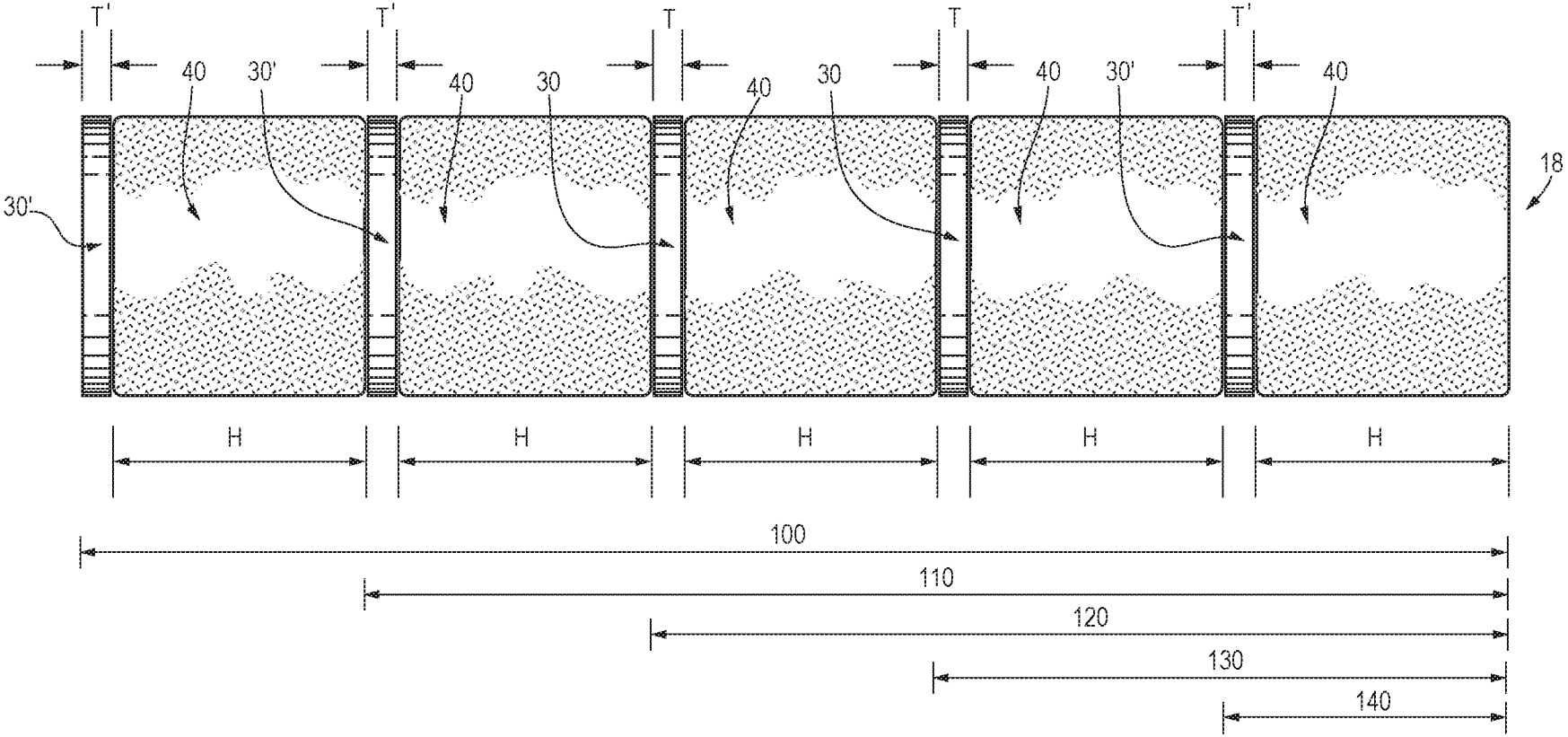
FIG. 16 is an elevation view of a schematic representation of a series of exemplary disc members and insulation foam members in accordance with embodiments presented herein.

FIG. 16 illustrates a series of alternating plurality of disc members 30, 30' and plurality of insulation foam members 40 that are concentrically aligned. As best illustrated in FIG. 16, the disc members 30, 30' can separate adjacent insulation foam members 40 by the varying thicknesses T, T'. As further illustrated in FIG. 16, the insulation foam members 40 can separate adjacent disc members 30, 30' by the varying longitudinal heights H. As best illustrated in FIG. 16, a first non-solid disc member 30' can be located at a first distance 100 from distal portion 18 of the ball bat (not shown). The first distance 100 can be between about 3 and 12 inches in one embodiment, between 4.5 and 10.5 inches in another embodiment, between 6 and 9 inches in yet another embodiment, and about 8.75 inches in a further embodiment. Further, as best illustrated in FIG. 16, a second non-solid disc member 30' can be located at a second distance 110 from distal portion 18 of the ball bat. The second distance 110 can be between about 2.25 and 10.25 inches in one embodiment, between 3.75 and 8.75 inches in another embodiment, between 5.25 and 7.25 inches in yet another embodiment, and about 7 inches in a further embodiment. Depending on the size and performance criteria of any given ball bat, a first solid disc member 30 can be located at a third distance 120 from distal portion 18 of the ball bat. The third distance 120 can be between about 1.50 and 9 inches in one embodiment, between 3 and 7.50 inches in another embodiment, between 4.50 and 6 inches in yet another embodiment, and about 5.5 inches in a further embodiment. Depending on the size and performance criteria of any given ball bat, a second solid disc member 30 can be located at a fourth distance 130 from distal portion 18 of the ball bat. The fourth distance 130 can be between about 0.75 and 8 inches in one embodiment, between 1.25 and 6.50 inches in another embodiment, between 2 and 5 inches in yet another embodiment, and about 2.75 inches in a further embodiment.

Depending on the size and performance criteria of any given ball bat, a third non-solid disc member 30' can be located at a fifth distance 140 from distal portion 18 of the ball bat. The fifth distance 140 can be between about 0.25 and 6.75 inches in one embodiment, between 0.50 and 5 inches in another embodiment, between 1 inch and 3.5 inches in yet another embodiment, and about 1.25 inches in a further embodiment.

In alternative embodiments, various combinations of disc members 30, 30', including non-solid disc members 30', 30", 30'", and disc members 30, 30' made of carbon fiber or polycarbonate, and disc members 30, 30' at various distances or spacings relative to one another may be provided. Such embodiments may be tailored to fit the particular size, performance, and/or weight drop requirements or preferences of any given ball bat.

From the foregoing, it will be seen that the various embodiments of the present invention are well adapted to attain all the objectives and advantages hereinabove set forth together with still other advantages which are obvious and which are inherent to the present structures. It will be understood that certain features and sub-combinations of the present embodiments are of utility and may be employed without reference to other features and sub-combinations. Since many possible embodiments of the present invention may be made without departing from the spirit and scope of the present invention, it is also to be understood that all disclosures herein set forth or illustrated in the accompanying drawings are to be interpreted as illustrative only and not limiting. The various constructions described above and illustrated in the drawings are presented by way of example only and are not intended to limit the concepts, principles and scope of the present invention.

As is evident from the foregoing description, certain aspects of the present invention are not limited by the particular details of the examples illustrated herein, and it is therefore contemplated that other modifications and applications, or equivalents thereof, will occur to those skilled in the art. The terms "having" and "including" and similar terms as used in the foregoing specification are used in the sense of "optional" or "may include" and not as "required."

Many changes, modifications, variations and other uses and applications of the present constructions will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

What is claimed is:

1. An apparatus comprising:

a ball bat comprising a barrel portion and an inner wall disposed within the ball bat;

at least one disc member having a first outer circumference with a solid and continuous center portion within the first outer circumference, the first outer circumference defining a first outer diameter; and at least one insulation foam member having a second outer circumference and a second center portion within the second outer circumference, the second outer circumference defining a second outer diameter;

wherein:

the barrel portion of the ball bat defines an inner diameter;

the first outer diameter of the at least one disc member corresponds with the inner diameter of the ball bat to create a fit within close proximity between the at least one disc member and the ball bat such that the first outer circumference of the at least one disc member is in contact with the inner wall of the ball bat; and the second outer diameter of the at one least insulation foam member corresponds with the inner diameter of the ball bat to create a fit within close proximity between the second outer circumference of the at least one insulation foam member and the inner wall of the ball bat; and wherein an end of the at least one insulation foam member contacts at least part of the solid and continuous center portion of the at least one disc member.

2. The system of claim 1, wherein the at least one disc member is in friction fit with the inner wall of the ball bat.

3. The system of claim 1, wherein the at least one insulation foam member is in friction fit with the inner wall of the ball bat.

4. The apparatus of claim 1, wherein the at least one insulation foam member comprises a hollow center portion.

5. The apparatus of claim 1, wherein the at least one disc member defines a thickness of about 0.125 inches.

6. The apparatus of claim 1, wherein the at least one insulation foam member defines a height of about 1.5 inches.

7. A system comprising:

a ball bat comprising a barrel portion and a distal portion; and at least one disc member that is disposed within the barrel portion of the ball bat;

wherein:

the barrel portion defines an inner diameter;

the at least one disc member having a first outer circumference with a first center portion within the first outer circumference, the first outer circumference defining an outer diameter;

the outer diameter of the at least one disc member corresponds with the inner diameter of the barrel portion of the ball bat to create a fit within close proximity therewith such that the first outer circumference of the at least one disc member is in contact with the inner wall of the ball bat; and an insulation member having a second outer circumference with a second center portion within the second outer circumference and first and second ends; and wherein one of the first and second ends of the insulation member contacts at least part of the first center portion of the at least one disc member.

8. The system of claim 7, wherein:

the barrel portion further comprises an inner wall member;

the at least one disc member comprises an outer circumference; and the inner wall member of the barrel portion and the outer circumference of the at least one disc member correspond to create a friction fit.

9. The system of claim 7, wherein:

the center portion of the at least one disc member comprises a solid and continuous center portion; and the at least one disc member is located within a sweet spot of the ball bat.

10. The system of claim 9, wherein the at least one solid disc member is located within the barrel portion of the ball bat between about 5 to 7 inches from the distal portion of the ball bat.

11. The system of claim 7, wherein the at least one disc member comprises at least two solid disc members, each having a solid and continuous center portion, located within a sweet spot of the ball bat.

12. The system of claim 11, wherein the at least one insulation foam member is placed between the at least two disc members and wherein the first end of the insulation foam member directly contacts the solid and continuous center portion of one of the at least two disc members and the second end of the insulation foam member directly contacts the solid and continuous center portion of the other of the at least two disc members.

13. The system of claim 12 wherein the at least two disc members and the at least one insulation foam member are concentrically aligned.

14. The system of claim 11, wherein the at least two solid disc members are located within the barrel portion of the ball bat between about 5 to 7 inches from the distal portion of the ball bat.

15. The system of claim 7, wherein:

the ball bat further comprises a tapered portion; and the at least one disc member is located substantially where the tapered portion of the ball bat and the barrel portion of the ball bat meet.

16. The system of claim 15, wherein the at least one disc member comprises at least one hole passing through the center portion thereof.

17. The system of claim 15, wherein the at least one disc member is located about 8.75 inches from the distal portion of the ball bat.

* * * * *